US010501879B2

(12) United States Patent
Newland et al.

(10) Patent No.: US 10,501,879 B2
(45) **Date of Patent: *Dec. 10, 2019**

(54) FLEXIBLE AND WATERPROOF LAUNDRY DEVICE HAVING A FRICTIONAL WASHING SURFACE

(71) Applicant: CALIBRE8 PTY LTD, Richmond (AU)

(72) Inventors: Ashley Martin Newland, Richmond (AU); Jean-Paul Pearce, Mile End (AU)

(73) Assignee: CALIBRE8 PTY LTD, Richmond (AU)

( * ) Notice: Subject to any disclaimer, the term of this patent is extended or adjusted under 35 U.S.C. 154(b) by 365 days.

This patent is subject to a terminal disclaimer.

(21) Appl. No.: 15/363,968

(22) Filed: Nov. 29, 2016

(65) Prior Publication Data

US 2017/0204550 A1 Jul. 20, 2017

Related U.S. Application Data

(63) Continuation of application No. 13/699,528, filed as application No. PCT/AU2011/000597 on May 22, 2011, now Pat. No. 9,534,327.

(30) Foreign Application Priority Data

May 26, 2010 (AU) ..... 2010902301

(51) Int. Cl.

| | |
|---|---|
| ***D06F 5/00*** | (2006.01) |
| ***D06F 1/00*** | (2006.01) |
| ***D06F 1/04*** | (2006.01) |

(52) U.S. Cl.
CPC ..... *D06F 5/005* (2013.01); *D06F 1/00* (2013.01); *D06F 1/04* (2013.01); *Y10T 29/49826* (2015.01)

(58) Field of Classification Search
None
See application file for complete search history.

(56) References Cited

U.S. PATENT DOCUMENTS 2,596,791 A * 5/1952 Rand ..... D06F 27/00 68/21
3,519,005 A 7/1970 Krezanoski et al.
(Continued)

FOREIGN PATENT DOCUMENTS

CN 205024462 U * 2/2016
DE 10161050 A1 6/2003
(Continued)

OTHER PUBLICATIONS

International Search Report prepared by the Australian Patent Office for International Application No. PCT/AU2011/000597 dated Jun. 23, 2011.

*Primary Examiner* — Rita P Adhlakha
(74) *Attorney, Agent, or Firm* — Berg Hill Greenleaf Ruscitti, LLP

(57) ABSTRACT

The present invention relates to a laundry device including: i) a flexible waterproof housing for housing a textile item, water and cleaning material; ii) an opening in the housing for inserting or removing the textile item; and iii) a seal for sealing the opening; wherein an inner surface of the housing includes a frictional washing surface against which the textile item is rubbed to effect cleaning by gripping or pressing on an outer surface of the housing to press and rub the textile item against the frictional washing surface.

20 Claims, 5 Drawing Sheets

(56) References Cited

U.S. PATENT DOCUMENTS

| | | | |
|---|---|---|---|
| 4,488,918 | A | 12/1984 | Jofs |
| 4,758,465 | A | 7/1988 | McKinney et al. |
| 4,903,718 | A | 2/1990 | Sullivan |
| 5,234,740 | A | 8/1993 | Reeves et al. |
| 6,219,871 | B1 | 4/2001 | Frederick et al. |
| 6,904,615 | B2 | 6/2005 | Kobe et al. |
| 7,823,600 | B2 | 11/2010 | Laakso et al. |
| 2009/0324143 | A1 | 12/2009 | Sharp et al. |

FOREIGN PATENT DOCUMENTS

| | | | |
|---|---|---|---|
| EP | 1676947 | A1 | 7/2006 |
| GB | 2378712 | A | 2/2003 |
| WO | 03032855 | A1 | 4/2003 |
| WO | 2005007303 | A1 | 1/2005 |
| WO | 2005026434 | A1 | 3/2005 |

* cited by examiner

FIG. 4A
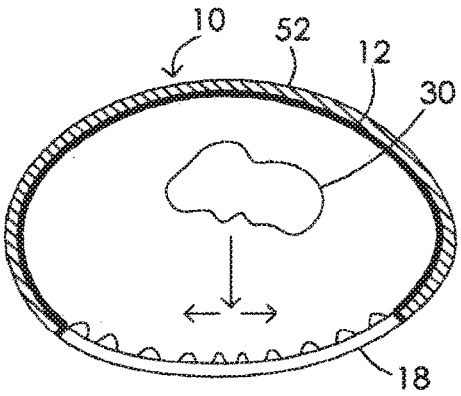
FIG. 4C
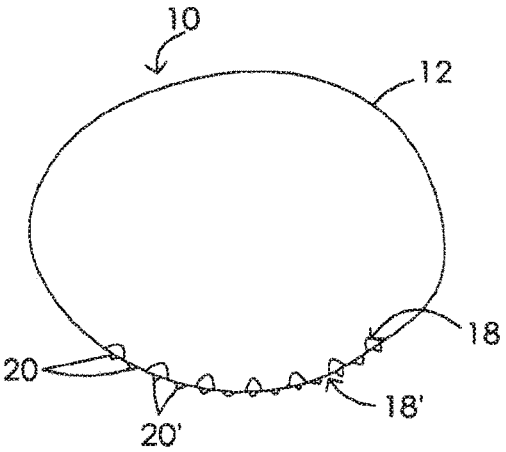
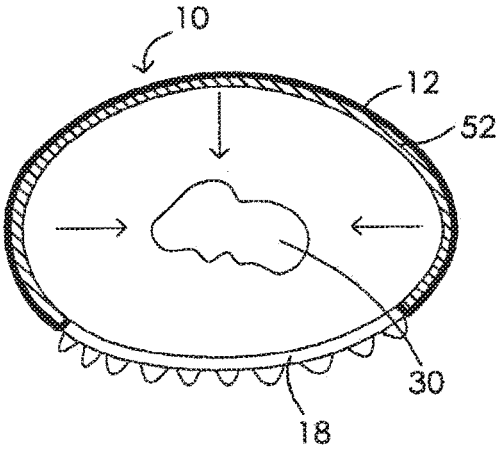
FIG. 4B
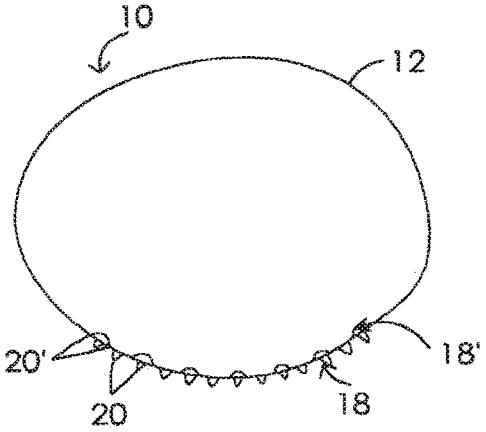
FIG. 4D

FLEXIBLE AND WATERPROOF LAUNDRY DEVICE HAVING A FRICTIONAL WASHING SURFACE

CROSS REFERENCE TO RELATED APPLICATIONS

This application is a continuation of U.S. patent application Ser. No. 13/699,528 filed May 24, 2013, which is a national stage application under 35 U.S.C. 371 and claimed the benefit of PCT Application No. PCT/AU2011/000597, having an international filing date of May 22, 2011, which designated the United States, which PCT application claimed the benefit of Australian Application No. 2010902301 filed May 26, 2010, the entire disclosures of which are incorporated herein by reference.

FIELD OF THE INVENTION

The present invention relates to a laundry device for washing textiles.

BACKGROUND

Washing clothing while travelling can be a difficult and/or time consuming task. Many travellers, in particular backpackers and campers, choose to pack light and may only have a few changes of clothing. Accordingly, they must wash their clothing on a regular basis. Paying for clothing to be washed while travelling can be expensive. While Laundromats can be marginally more cost-effective, they can also be hard to find and generally require users to stay in the vicinity during the washing process to ensure their clothing is not stolen. Personal safety concerns can limit the use of Laundromats to daylight hours.

An alternative approach for washing clothing while travelling is to plug a hotel basin and wash the clothing therein. However, the cleanliness (or lack thereof) of the basin may be unappealing for washing clothing in. Furthermore, if the basin is a communal basin, other travellers are likely to want to use the basin, which can limit the ability to adequately clean the clothing. It can also be difficult to wash clothing with vigour as water is likely to spill over the basin and/or the taps may get in the way. Indeed, some people may also be sensitive to washing materials (e.g. soaps, washing liquid, detergents) or simply may not desire to get their hands wet during the washing process. In some instances, particularly in remote areas (e.g. while camping or trekking), fixed basins may not be available and it may not be practical to carry a portable basin or bucket for washing clothing.

It is therefore desirable to provide an effective portable laundry device for washing clothing or other textiles while travelling.

BRIEF DESCRIPTION OF THE DRAWINGS

FIG. 4A shows a cross-sectional view of the laundry device according to a sixth embodiment of the present invention and shows an absorbent material on the outside of the housing.

FIG. 4B shows a cross-sectional view of the laundry device according to the sixth embodiment of the present invention with the housing inverted.

FIG. 4C shows a cross-sectional view of the laundry device according to a seventh embodiment of the present invention and shows a second frictional washing surface on the outside surface of the housing.

FIG. 4D shows a cross-sectional view of the laundry device according to the seventh embodiment of the present invention with the housing inverted.

DETAILED DESCRIPTION

Figure 1A:
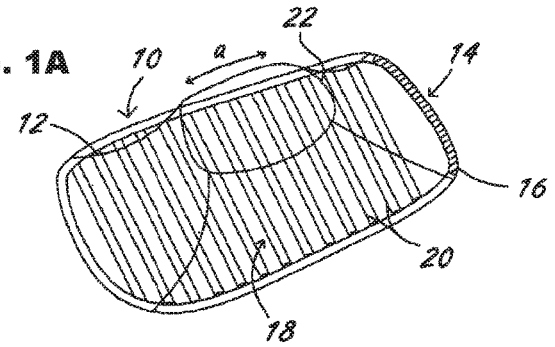
FIG. 1A is a perspective view of a first embodiment of the invention illustrating the waterproof housing as being transparent for the purposes of viewing the interior of the housing including details of the frictional washing surface.

The present invention provides a laundry device including: i) a flexible waterproof housing for housing a textile item, water and cleaning material; ii) an opening in the housing for inserting or removing the textile item; and iii) a seal for sealing the opening; wherein an inner surface of the housing includes a frictional washing surface against which the textile item is rubbed to effect cleaning by gripping or pressing on an outer surface of the housing to press and rub the textile item against the frictional washing surface. The textile item may include, for example, an item of clothing, bedding (e.g. pillowcase or sheet), a towel, headgear, cloth, hosiery, handkerchief, etc.

The device according to the present invention is advantageous as the friction between the textile and the washing surface in the housing as a result of the application of an external force (e.g. a user gripping or pressing on the textiles through the bag and rubbing the textiles against the washing surface) can accelerate or improve the washing process (e.g. the amount of time required for effective soaking may be reduced and/or stains may be more effectively removed). Compared to using a basin for washing clothing or a washboard, the device according to the present invention can also allow the user to wash their clothing or other textiles with minimal direct handling of the wet clothing and/or the cleaning material and water. In some embodiments, the laundry device may allow textiles to be washed with less water than would be used for conventional washing.

In use, partial filling of the housing (with water, textiles and cleaning material) can allow a user to apply an appropriate external force to press and rub the textiles against the frictional washing surface. As can be appreciated, the optimal filling level will depend on the shape of housing, which as described later, may vary. For example, the optimal filling level may be any percentage between 10% and 65%, between 20% and 55% or between 35% and 50% of the sealed housing capacity. In some embodiments, the housing may include one or more markings to show the optimal filling level.

The laundry device according to the present invention provides travellers with an effective and portable device for washing clothing. The laundry device may equally benefit soldiers who are operating in areas with limited electricity or home occupants who are space conscious or environmentally conscious (i.e. can't fit or don't want to use a washing machine). As the housing is flexible, it may be particularly suitable for travelling as the laundry device may be flexed into a compact form and can be used instead of a basin, a bucket or the like. In some embodiments, the frictional washing surface may also be flexible.

Reference to any prior art in this specification is not, and should not be taken as, an acknowledgment or any form of suggestion that this prior art forms part of the common general knowledge in any country. Furthermore, it must be noted that, as used herein, the singular forms "a", "an" and "the" include plural aspects unless the context already dictates otherwise.

To provide the reader with an appreciation for the present invention and to provide context in relation to the following description, an embodiment of the invention will be briefly described.

In use, textiles (e.g. clothing) are introduced into the housing through the opening as well as water and the cleaning material (e.g. detergent, soap, washing liquid, washing powder, washing leaves, shampoo, etc.). The waterproof housing may be only partially filled with water to allow the user to grip or press the textiles against the washing surface from outside the housing once sealed. Air may be removed from the housing via the opening and the housing may then be sealed, or advantageously air may be removed from the housing through an outlet (e.g. a valve) after sealing (as described later herein). The housing may be placed on the ground, a bench or other suitable surface with the washing surface on the bottom. The user may grip and/or press the textiles (or part thereof) against the washing surface from the outside of the housing. Maintaining or applying pressure on the textiles, the user may rub the textiles back and forth or in a circular motion against the washing surface. The textiles may also be allowed to soak in the device to augment the washing process. The seal may then be opened and liquid drained from the housing. As the housing is flexible, the housing may be twisted, compressed, or rolled to expel water from the textiles and housing, thus partially drying the textiles. The textiles may then be rinsed in the housing, wrung out and finally hung up to dry. Now that an embodiment of the invention has been described, attention will now be directed to describing alternative arrangements and embodiments of the present invention.

The washing surface is not particularly limited and may include a relatively rigid washing surface or a flexible washing surface. In some embodiments, the washing surface may be flexible in at least one direction (e.g. allowing the housing to be rolled up). Preferably, the washing surface will be flexible in multiple directions. In some embodiments, the washing surface may substantially conform to the shape of surfaces it is placed on. For example, if placed on a flat surface (e.g. a table, bench, car bonnet), the washing surface may assume a substantially flat conformation and if placed on a curved surface (e.g. undulating or rough ground, rocks, a user's lap, etc), the washing surface may conform to the shape of the curved surface. In this regard, the housing may be used on a range of different surfaces, which can be important when travelling, especially in remote areas where flat surfaces may be difficult to find. In some embodiments, placing the washing surface on a curved or undulating surface may assist in the cleaning process.

The term 'frictional washing surface' as used herein is intended to mean a surface, which includes raised portions and/or depressed portions that increase the friction between the surface and textiles which are rubbed along or across the surface. As such, any suitable frictional washing surface may be used. In some embodiments, the washing surface may include a plurality of projections (e.g. ridges, knobs, or the like) and/or depressions (e.g. inundations, divots, channels, etc.). In some embodiments, the depressions may be inherently delineated by projections. The projections and/or depressions may be elongate, connected to other projections or depressions, discrete units, uniformly shaped, or irregularly shaped. In some embodiments, the projections and/or depressions or parts thereof may have a tapered profile. For example, the projections and/or depressions may include a semi-circular, circular segment, semi-ellipsoidal, ellipsoidal segment, pyramidal, triangular shaped, pentagonal shaped, or wave shaped cross-section. Alternatively, the projections and/or depressions may include a quadrangular shaped cross-section. In some embodiments, the washing surface may include a plurality of differently shaped or sized projections and/or depressions. The projections and/or depressions may cover all or part of the washing surface. To minimise damage to the textiles, the washing surface may be a low abrasive surface (e.g. protrusions are preferably relatively blunt and/or composed of a resilient material).

Different shaped and sized projections and/or depressions may be suitable for different washing purposes. For example, large well-defined projections and/or depressions may be used for durable (e.g. denim materials) and/or heavily soiled clothing while smaller or less pronounced projections and/or depressions may be used for delicates (e.g. ladies underwear or clothing made from delicate materials, such as silk). In some embodiments, the washing surface may include two or more regions, each with different sized, shaped and/or configured projections, depressions and/or holes. In this regard, different regions of the same washing surfaces may be used for different textiles.

In some embodiments, the washing surface may make up less than 50%, less than 40%, less than 30% or less than 20% of the total inner surface of the housing. Such percentages can assist in maintaining a high degree of flexibility of the housing when in use and minimise weight of the device. The projections and/or depressions may be uniformly distributed on the housing and/or may be concentrated around a midpoint of the length or width of the housing.

In some embodiments, the projections and/or depressions may be provided in a parallel arrangement, hatched arrangement, perpendicular arrangement, zig zag arrangement, rippled arrangement, or other suitable arrangement. In some embodiments, the washing surface may include a path through the projections and/or depressions to allow residual water to effectively drain from the washing surface (e.g. the projections and/or depressions may be angled towards a direction of drainage and/or may include channels through the projections and/or depressions to provide a drainage pathway).

In some embodiments, the projections and/or depressions may be multidirectional (e.g. they may allow cleaning of textiles when rubbed in more than one direction). For example, parallel ridges may allow textiles to be cleaned by rubbing them back and forth against the ridges. However, knobs or other discrete projections may allow textiles to be cleaned when textiles are rubbed in more directions. If cleaning against the washing surface is only intended in one direction (or one reversible direction), the washing surface may be longer in that direction to allow better cleaning of the textiles for each stroke of the textiles against the washing surface. In some embodiments, the washing surface may resemble a traditional or modern washboard, which may be relatively rigid or composed of a flexible material.

As described above, different sized projections and/or depressions may be used, which may depend on the desired washing application and/or desired compactness (e.g. smaller projections and/or depressions may be used to keep the waterproof housing compact for ultra light travellers). In some embodiments, the projections and/or depressions may have a height or depth of between 0.5 mm and 10 mm. Larger or smaller projections and/or depressions are also contemplated by the present invention. In some embodiments, the projections and/or depressions may have a height of approximately 1-6 mm or 1.5-4 mm. These heights may still allow effective cleaning of clothing or other textiles by pressing and rubbing the clothing against the washing surface, while allowing the washing surface and housing to maintain a relatively compact size. In some embodiments, the washing surface may include different sized projections and/or depressions.

In some embodiments, the washing surface may include a base on which the projections and/or depressions are provided. The base may confer additional stability to the frictional washing surface, prevent projections and/or depressions from bunching up, and/or distribute pressure over a wider area, which may reduce wear on the housing or gripping surface (described below). In some embodiments, the base may cover an aperture in the housing. In this regard, one side of the base may make up part of the exterior surface of the housing and may optionally provide a gripping surface as described below. Alternatively, the projections and/or depressions may be provided on or attached to the inner surface of the housing.

In some embodiments, the base may include one or more flex lines (straight or curved) to increase the flexibility of the washing surface, which can assist in folding or inverting the laundry device. For example, flex lines running perpendicular to the length or breadth of the housing may assist in folding the laundry device while flex lines that are not perpendicular or parallel to the length of the housing (e.g. flex lines at an acute angle to the length or breadth of the housing) may assist in inverting the housing and/or wringing out wet clothes in the housing. The flex lines may include thinner sections of the base, perforated base sections, high flex material sections (i.e. more flexible than the rest of the base), or splits within the base.

In some embodiments, multiple inner surfaces (or all inner surfaces) of the housing may include projections and/or depressions. These projections and/or depressions may be used to provide additional washing surfaces (e.g. other sides of the housing may also contact the textiles in the housing and affect cleaning), or may assist in gripping the textiles in the housing as they are rubbed along the washing surface.

The materials that the frictional washing surface may be made from are not particularly limited. In some embodiments, the washing surface may be made from one or more of the same materials as the housing (as described below). In some embodiments, the washing surface may be substantially composed of one or more polymers or may be coated with one or more polymers. In some embodiments, the washing surface may be made from a petroleum derived compound or coated with a petroleum derived compound. In some embodiments, the washing surface may be made from and/or coated with any one or more of the following materials: silicone, latex, nylon, polyethylene, neoprene, vinyl, polypropylene, polyurethane, viton rubber, PVC, PVC substitute, polyurethane, polyethylene terephthalate (PET), natural rubber, EPDM rubber, nitrile, butyl rubber, hypalon, pure gum rubber, FRAS, polyolefin, polypropylene (PP) and derivatives or combinations of any of the foregoing.

In some embodiments, the washing surface may be integral to the waterproof housing as it is produced. Alternatively, the washing surface may be bonded or otherwise attached to the housing.

As described above, the laundry device includes a flexible waterproof housing. The term "flexible" as used herein in relation to the housing is intended to mean that at least a portion of the housing is flexible. Thus, some parts or components of the housing may be relatively rigid. For example, the housing may include relatively rigid side walls with an elastic wall opposite to the washing surface, which is capable of being stretched to contact the washing surface, and thereby rub textiles against the washing surface to wash the textiles. In some embodiments, substantially the entire housing may be flexible.

As the housing retains liquids while the clothing is being washed, including while the clothing is being rubbed along the washing surface, the housing may be made from a relatively durable material that resists tearing, bursting and/or degradation from cleaning materials. In some embodiments, the housing may include a polymer. For example, in some embodiments, the housing may include a material selected from the group including: a flexible plastic, nylon, a polymer, an elastomer, a thermoset rubber, silicone and combinations or derivatives of any of the foregoing.

In some embodiments, the housing may include one or more of the following materials: silicone, latex, nylon, polyethylene, neoprene, vinyl, polypropylene, polyurethane, viton rubber, PVC, PVC substitute, polyurethane, polyethylene terephthalate (PET), natural rubber, EPDM rubber, nitrile, butyl rubber, hypalon, pure gum rubber, FRAS, polyolefin, polypropylene (PP), polyethylene, polyethylene terephthalate polyester (PETP), polytrimethylene terephthalate (PTT), polybutylene terephthalate (PBT), polyamide, polyester, polytetrafluoroethylene, FRAS, and derivatives or combinations of any of the foregoing.

In some embodiments, the housing may have a thickness between 750 nm and 750 μm, between 750 nm and 550 μm, between 750 nm and 350 μm or between 750 nm and 220 μm. The thickness of the housing can influence the durability, weight and flexibility of the housing. Generally speaking, a thicker housing will have higher durability and weight and lower flexibility than a housing composed of the same material (e.g. a blown PVC film housing). A trade off may therefore exist between using a thinner housing to reduce the housing weight (lightweight products are generally desired in the travel industry) and a thicker housing to provide increased durability. As described below, the housing may also include synthetic or natural fibres, which may be used to increase the durability of the housing without compromising the housing weight.

The fibres may be individual fibres or may be part of a woven fabric, a non-woven fabric, filaments, threads or yarns. The fibres, fabrics, filaments, threads or yarns may be coated, encapsulated or impregnated with a polymer. In some embodiments, the fibres may be included in the housing as an unorganised arrangement of fibres (e.g. mixed with or coated onto a liquid polymer or polymer layer), matted together or included as an organised arrangement of fibres, filaments, threads or yarns (e.g. a woven fabric, scrim or one or more layers or lines of unidirectional fibres). The term scrim, as used herein is intended to mean a base fabric component created by laying out fibres, filament or thread in a grid pattern and joining them at the intersections (e.g. by knitting, tying or adhering). In some embodiments, the fibre, filament, thread or yarn may have a denier between 0.5 and 600, between 1 and 300, or between 20 and 220. In some embodiments, the fibre may include a microfibre (e.g. <0.5 denier).

As mentioned above, the use of fibres in the housing can increase the durability of the housing (e.g. increase the tear resistance, increase the puncture resistance, increase the wear resistance, reduce flex fatigue and/or reduce stretching or deformation of the housing). Other advantages of using fibres may include improved feel of the housing and/or reduced incidence or appearance of flex associated wear (e.g. creases or residual marks from bending or deforming the housing). Fibres can also allow flexing of the housing with loss of strength compared to housings without fibres (e.g. blown plastic films). Each of these features can be important when users grip or press on the housing to press and rub clothing against the washing surface, which is the most effective way to use to the laundry device to clean clothing. Furthermore, the inclusion of fibres can reduce the quantity of polymer required in the housing to achieve a desired feel and/or durability (e.g. when compared to the use of blown films without fibres). Reducing the quantity of polymer can reduce the weight of the housing and/or improve the flexibility of the housing, which are important considerations for travellers. Furthermore, as some polymers such as PVC become relatively stiff at low temperatures, minimising the quantity of the polymer in the housing can reduce limitations of the material while retaining benefits.

The fibres may include cellulose fibres, mineral fibres, polymer fibres, microfibres, vegetable fibres, wood fibres, or animal fibres. Examples of such fibres include: nylon fibres, polyester fibres (e.g. Dacron®, PET, PBT), ultra high molecular weight polyethylene fibres (e.g. Dyneema®, Spectra®, Pentex®, Certran®), liquid crystal polymer fibres (e.g. Vectran®, Zylon PBO®), aramid fibres (e.g. Kevlar® (including Kevlar®49 or Kevlar®Edge™), Technora®, Twaron®, Nomex®), carbon fibres, phenol-formaldehydes (PF), polyvinyl alcohol fibres (PVA), polyvinyl chloride fibres, polyolefin fibres (PP or PE), PBO Zylon fibres, PEN fibers (Polyethylene Napthalate), poly-urethane fibres, rayon fibres, cotton fibres, silk fibres, wool fibres, linen fibres, hemp fibres, coir fibres, and jute fibres.

In embodiments wherein the fibres, filaments, threads, yarns or fabrics are coated with a polymer, the polymer coat may be a thin coat (e.g. between 100 nm and 500 nm). In some embodiments, the polymer coat may be between 100 nm and 50 μm or between 100 nm and 200 μm, or between 100 nm and 300 μm. Thicker coatings may be used although some of the flexibility and/or weight advantages may be reduced.

In some embodiments, the polymer used to coat, impregnate or encapsulate the fibres, filaments, threads, yarns or fabrics may be used in a quantity of between 4 $g/m^2$ and 50 $g/m^2$, between 15 $g/m^2$ and 40 $g/m^2$, or between 20 $g/m^2$ and 30 $g/m^2$ or more than 30 $g/m^2$. In some embodiments, the fibres, filaments, thread, yarn or fabrics (e.g. in the form of a woven fabric) may be impregnated with silicone and coated with a urethane on one or both sides.

In some embodiments, the polymer used to coat, impregnate or encapsulate the fibres, filaments, threads, yarns or fabrics may include a urethane (including, for example, silicone-modified polyurethanes), a silicone (including, for example, fluorosilicones), a PVC, a PVC substitute, a vinyl, an acrylic, a polytetrafluoroethylene, a polyester (e.g. PET, PEN, Mylar®), a polyamide, a polyimide (e.g. Kapton®, Upilex®, CP1®), a para-aramid, a flouroplymer (e.g. PVF, ECTFE, ETFE), a DWR, a latex coating, any other suitable polymer, or a combination of any of the foregoing. When used to coat fabrics, the polymer may be provided on the inner surface, outer surface or both surfaces of the fabrics. Specific examples of suitable coated or impregnated woven fabrics include urethane coated nylon, PVC coated nylon and silnylon. Coating the fibres, filaments, threads, yarns or fabrics may include lamination. In some embodiments, the polymer used may be heat resistant to 50° C., 70° C., 90° C. or 100° C.

In some embodiments, the fabric may include a specific weave pattern or process to increase durability and/or reduce weight. For example, the fabric may include a ripstop fabric, a Cordura® fabric, a Kodra fabric, an Oxford weave fabric or a Taffeta® fabric. In some embodiments, the fibres may be laid side-by-side to form a uni-directional layer of fibres, thereby reducing creep or crimp that may occur with some woven fabrics. Multiple layers may be used with the fibre layers being oriented in different directions (e.g. 30°, 45° or 90° to the first layer) to increase strength of the fabric in multiple directions. In some embodiments, the waterproof housing may include a $CTF^3$ fabric (CUBIC TECH CORP) or Cuban fabric (plasma treated ultra high molecular weight polyethylene fibers and monofilament polyester film).

In some embodiments, the waterproof properties of the housing may be replenished or restored by contacting the housing with mild heat (e.g. a warm iron) to soften and reset waterproof polymers associated with fibres of the housing or by the application of a waterproof coating (e.g. a DWR/permanent fluropolymer spray or the like) or a patch may be applied to seal punctures or tears.

In some embodiments, the housing may include a multi-layer film or laminate. Examples of durable and/or waterproof multi-layer films or laminates include those described in US 2009/0324143. The different layers may confer the housing with different properties. For example, the housing may include one or more waterproof layers, one or more temperature insulative layers, one or more strengthening layers (e.g. to confer improved burst, stretch, puncture, tear resistance), one or more microbial resistant layers (e.g.

antifungal, antibacterial layer), one or more gripping layers, and/or one or more chemical resistant layers (e.g. resistance against degradation from cleaning materials including, for example, detergents, alkalis, acids, soaps or bleach). In some embodiments, one or more layers may include a film or a coating. Coatings may include any known in the art including, for example, those described in U.S. Pat. No. 4,758,465. In some embodiments, the multi-layer film or laminate may include fibres, filaments, threads, yarns or fabrics, as described above. For example, the laminate may include any of the following layer combinations: Woven/Film/Woven or Woven/Film; Film/Scrim/Film or Film/Insert/Film; Woven/Film/Scrim/Film/Woven; or Woven/Scrim/Woven.

The housing may have a shape that allows effective gripping/pressing of the textile through the housing and rubbing of the textiles against the washing surface. In some embodiments, the housing may have a tubular shape with the washing surface provided on an end wall or side wall of the tube. In some embodiments, the housing may have a pyramidal shape, a box shape, a cone shape, a frustoconical shape, a frustopyamidal shape, or other polygonal shape. Frustums or tubular shapes may be advantageous in that more textiles may be gripped with less of the material of the housing being trapped between the textiles and the frictional washing surface. This may increase the washing efficiency of the device. In the case of frusto shapes, the side walls preferably have a sufficient length to allow textiles, which are gripped or pressed through the housing to be rubbed against a significant portion of the washing surface. In some embodiments, the housing may include two flat walls joined along multiple edges (i.e. the walls of the housing may lie together flat when the housing is empty).

In some embodiments, the housing may allow textiles to be gripped/pressed and rubbed against at least 20%, 40%, 60%, 80%, or 90% of the length of the washing surface. Factors, which may influence the length of the washing surface against textiles may be rubbed include, for example, the amount of textiles gripped/pressed through the flexible housing, the elasticity of the housing, and the length of the housing relative to the length of the washing surface. These factors may be adjusted to obtain the desired result.

In some embodiments, the housing may have a volume of between about 2 L and 40 L. In some embodiments, the housing may have a volume of between about 4 L and 15 L or between about 8 L and 15 L. In some embodiments, the laundry device may weigh between about 30 g and 1500 g, 30 g and 500 g, between about 80 g and 400 g, or between about 80 g and 250 g.

In some embodiments, the area of the opening when the opening is in a fully open configuration is greater than 30 $cm^2$, greater than 50 $cm^2$, greater than 100 $cm^2$, greater than 150 $cm^2$, greater than 200 $cm^2$ or greater than 300 $cm^2$. The area of the opening can influence the ease of getting textiles in and out of the housing and/or the ease of inverting the housing.

A wide range of seals may be used to seal the opening in the housing. In some embodiments, the seal may include a waterproof zipper, a fold-over seal, a roll-down seal, a zip-lock seal, drawstring, crimp seal, releasable glue/sticky seal, hydrophobic material seal, or a clamping seal, etc. These and other types of seals are generally known in the art. Zip-lock seals may include, for example, MaxiGrip closures from ILLINOIS TOOL WORKS. Roll-down seals may be particularly suitable as they are simple to manufacture and have good burst resistance. In some embodiments, the roll-down seal may include opposing straps delineating the opening and the housing may include fasteners at each end. To seal the opening, opposing straps are brought together and rolled down the housing (at least 3, 4 or 5 times). The fasteners may be brought together and clipped or otherwise joined together thereby curving the straps and preventing unrolling. The straps may include, for example, fabric webbing straps or rubber/plastic stiffeners. In some embodiments, a clamp may be used in place of the fasteners to maintain the straps in a rolled down configuration.

In some embodiments, the seal may include a combination of one or more seal types. For example, in some embodiments, the seal may include a roll-down seal and a zip-lock seal. In some embodiments, the roll-down seal may resist the majority of the bursting pressure in the housing during use, while the zip-lock seal (e.g. provided on or adjacent to a fold line of the roll-down seal) may prevent seepage or wicking that may occur from the roll-down seal.

In some embodiments, the seal and/or waterproof housing may be burst resistant during normal operation. For example, in some embodiments, the seal and/or waterproof housing may resist bursting at pressures greater than 0.5, 1, 2, 4, 8, 12, 16, 20, 24, or 28 psi. The likelihood of bursting of the seal or the housing may be reduced by substantially removing all the air from the housing before pressure is applied to the sealed housing. As described above, air may be removed from the waterproof housing via the opening before it is completely sealed or via a valve. Roll down seals may be preferred over zip-lock style seals as internal pressure in the housing can burst the zip-lock seal allowing efflux through the opening. In contrast, the folds of the roll down seal provide a strong barrier between the contents of the housing and the opening, thereby increasing the burst resistance of the housing.

Overfilling the housing with clothing or water and/or the presence of air in the sealed housing can prevent a user from effectively griping and/or pressing and rubbing clothes against the washing surface through the housing. Accordingly, in some embodiments, the housing may include an outlet for expelling air from the sealed housing. In some embodiments, the outlet may have a surface area of less than 10 $cm^2$, less than 3 $cm^2$, less than 1 $cm^2$, less than 0.4 $cm^2$, or less than 0.1 $cm^2$ and may include a valve and/or cap to control airflow through the outlet. Suitable valves for releasing air through the outlet are generally known in the art and may include, for example, screw valves, plug or cap valves, ball valves, valves used for inflatable mattresses, beach balls, or the like. The valve may be made of a relatively soft material, which can minimise potential damage to the housing (e.g. a soft PVC valve). In some embodiments, an air valve may be used that allows air but not water to be expelled.

As described above, textiles may be washed in the housing by rubbing them against the frictional washing surface. In some embodiments, the outer surface of the housing may include a gripping surface which backs at least part of the washing surface. The gripping surface can be advantageous in that it may allow the washing surface to remain substantially in the same place during use (e.g. prevent the housing from sliding). If the washing surface moves as the textiles are rubbed against it and/or the projections/depressions bunch up (particularly if the washing portion doesn't include a base as described above), the laundry device will be less effective. In some embodiments, the gripping surface may include suction caps or a high friction flexible material (e.g. an elastomeric polymer). The gripping surface may also be advantageous in that it can provide a barrier between the waterproof housing and the surface it is used on, thereby reducing abrasion and wear of the waterproof housing.

The gripping surface may include an elastomeric polymer layer, an elastomeric polymer coat, or elastomeric polymer projections. The elastomeric polymer layer may take the form of a sheet, a mesh, lattice, or the like. In some embodiments, the gripping surface may include a grip surface as disclosed in U.S. Pat. No. 4,488,918, WO 2003/032855, U.S. Pat. No. 5,234,740, WO 2005/007303, or WO 2005/026434. In some embodiments, the gripping surface may be applied to the housing of the laundry device or materials for the production of the laundry device by methods known in the art including, for example, those disclosed in U.S. Pat. No. 4,488,918, WO 2003/032855, U.S. Pat. No. 5,234,740, WO 2005/007303 or WO 2005/026434. In some embodiments, the gripping surface may be applied to the housing or a material/component to be attached to the housing by calendar coating, cast coating, curtain coating, die coating, extrusion, gravure coating, knife coating, spray coating, planar screening, rotary screening, reverse rolling, transfer coating rotogravure transferring, or the like. Hot melt rotogravure line application of a plurality of gripping elements may be particularly useful in reducing the weight of the gripping surface as described in WO 2005/007303.

Examples of suitable classes of elastomers may include anionic triblock copolymers, polyolefin-based thermoplastic elastomers, thermoplastic elastomers based on halogen-containing polyolefins, thermoplastic elastomers based on dynamically vulcanized elastomer-thermoplastic blends, thermoplastic polyether ester or polyester based elastomers, thermoplastic elastomers based on polyamides or polyimides, ionomeric thermoplastic elastomers, hydrogenated block copolymers in thermoplastic elastomer interpenetrating polymer networks, thermoplastic elastomers by carbocationic polymerization, polymer blends containing styrene/hydrogenated butadiene block copolymers, and polyacrylate-based thermoplastic elastomers.

In some embodiments, the elastomer may include, for example, a thermoplastic elastomer or thermoset elastomer. Thermoplastic elastomers include, for example, styrenic block copolymers, polyolefin blends, elastomeric alloys (TPE-v or TPV), thermoplastic polyurethanes, thermoplastic copolyesters and thermoplastic polyamides. The elastomers may include, for example, natural rubbers, butyl rubbers, EPDM rubbers, silicone rubbers (e.g. polydimethyl siloxane), polyisoprenes, polybutadienes, polyurethanes, ethylene/propylene/diene terpolymer elastomers, chloroprene rubbers, styrene-butadiene copolymers (random or block), styrene-isoprene copolymers (random or block), acrylonitrile-butadiene copolymers, acrylics, epoxies, polyvinyl chlorides, neoprenes, nitriles, Viton®, polyethylenes, polystyrenes, silicones, Hypalon®, mixtures thereof and copolymers thereof. The block copolymers may include, for example, linear, radial or star configurations and may be diblock (AB) or triblock (ABA) copolymers or mixtures thereof. Blends of these elastomers with each other or with modifying non-elastomers are also contemplated. Commercially available elastomers include block polymers (e.g., polystyrene materials with elastomeric segments), available from KRATON Polymers Company of Houston, Tex., under the designation KRATON™. The elastomeric resin materials, such as those described above, may also have added to them any of a number of customary additives, including, for example, plasticizers, silica, tackifiers, fillers, antioxidants, UV absorbers, hindered amine light stabilizers (HALS), dyes or pigments, opacifying agents and the like.

In some embodiments, the gripping surface may have a static or dynamic coefficient of friction greater than 0.5, greater than 0.75, greater than 1.0, greater than 1.25, greater than 1.50, greater than 2.0, greater than 2.5, or greater than 3.0. Methods for determining the coefficient of friction are as described in WO 2003/032855. In some embodiments, the gripping surface may have a wet static or wet dynamic coefficient of friction greater than 0.5, greater than 0.75, greater than 1.0, greater than 1.25, greater than 1.50, greater than 2.0, greater than 2.5, or greater than 3.0. Gripping surfaces with a high wet coefficient of friction (e.g. those described in WO 2003/032855) may be advantageous for the present laundry device as a user may accidentally wet the surface they are using the laundry device on or the gripping surface.

In some embodiments, the waterproof housing itself may be made of a high friction material or include a high friction outer layer (e.g. a coefficient of friction greater than any one of the values provided in the preceding paragraph). In this regard, the housing may be dipped, brushed, sprayed or otherwise treated with a high friction flexible material to provide the gripping surface.

In some embodiments, the housing has an outer surface including a gripping portion backing at least part of the frictional washing surface and a non-gripping portion wherein the gripping portion has a coefficient of friction that is greater than the coefficient of friction of the non-gripping portion by at least 25%, at least 50%, at least 100%, at least 200%, at least 300%, at least 400%, at least 500%, at least 600%, at least 700% or at least 800%.

In some embodiments, the gripping surface may include a woven or non-woven fabric (e.g. cotton, hemp, nylon, polyester, etc) that is sewn onto or otherwise attached to the waterproof housing which acts as a substrate for a polymer. In this regard, the fabric may be coated or impregnated in part or in its entirety with a polymer (e.g. any one or more of the aforementioned elastomers) that is curable to provide a gripping surface on the fabric. If the fabric is sewn onto the waterproof housing, the seams may be sealed with sealing tape or sealant to keep the housing waterproof. Alternatively, a frictional washing surface including a base may be attached to the inside of the housing to cover and thereby seal the seams.

In some embodiments, the housing may include one or more restraining portions for restraining movement of the housing in at least one direction. The restraining portions may include, for example, one or more external tabs, flaps or the like onto which pressure may be applied to immobilise the tab or flaps and restrain the housing. In this regard, movement of the washing surface may also be restrained as textiles are rubbed thereagainst. In some embodiments, a user may place their foot or a heavy object onto one or more tabs or flaps, which may be provided on the device, to restrain movement of the housing. The tab or flap may include one or more apertures therethrough, such that a tent peg (or the like) may be used to fasten the tab to the ground or a rope, cord or the like passed though the aperture to tie the tab to a fixed or heavy object. In some embodiments, the restraining portion may include one or more external straps/cords, which may be tied to a fixed or heavy object or held to restrain movement of the housing in at least one direction.

In some embodiments, the laundry device may include an attachment member to enable the laundry device to be hung from an object to allow water to be drained from the housing. In some embodiments, the attachment member may be provided on or near the end of the housing opposite the sealable opening to orient the housing such the opening is the lowest point, thereby enabling water from the housing to drain though the opening when hung. The attachment member may include any suitable structure including, for example, a loop, a fastener (e.g. Velcro), a hook, one or more members that may be tied together or around an object (e.g. straps/cords) or a tabs with an aperture therethrough.

In some embodiments, the housing may include a transparent or translucent portion to allow visualisation of the contents of the laundry device. In this regard, a user may assess the progression of the washing process by looking through the portion at the colour or murkiness of the water or the state of the textiles. The user may also use the portion to check which textile item, of part thereof, they are rubbing against the washing surface. In some embodiments, the transparent or translucent portion may include a small part, a significant part, or substantially all of the housing. In some embodiments, the portion may include a transparent or translucent polymer (e.g. urethane, PVC, nylon, latex or other suitable material) or a polymer thickness that enables transparency or translucency.

In some embodiments, the housing may include an outlet for removing liquid from the housing while retaining the textiles in the housing (e.g. at the conclusion of the washing process). In some embodiments, the outlet may be provided substantially opposite to the opening, which can allow a continuous flow rinse to be performed (e.g. clean water may be added through the opening, across the textiles and out though the outlet). Alternatively, batch rinsing may be performed, which can minimise the amount of water used (e.g. the outlet is opened and closed during each batch rinse). The textiles may be retained in the housing if the outlet is too small for textiles to pass therethough (e.g. less than 30 $cm^2$ or less than 15 $cm^2$). In some embodiments, the housing may include an adjustable or fixed textile retainer for preventing textiles from passing though the opening or the water outlet. Examples of fixed textile retainers which may be provided in or near the outlet include mesh barriers, or the like. Keeping the textiles away from the outlet may be advantageous in that it can prevent the outlet from getting clogged, thereby allowing better expulsion of liquid from the housing. Examples of adjustable textile retainers include press studs which may be provided near the opening to allow water to be drained or wrung out of the textiles through the opening. The press studs can be pressed together when it is desired to retain the textile in the housing and pulled apart when it is desired to remove or insert the textile.

As the housing is flexible, in some embodiments, it may be twisted, rolled or compressed to wring out water from textiles in the waterproof housing when the opening is unsealed or an outlet is open. In some embodiments, projections, depressions and/or flex lines of the washing surface may be arranged to assist in wringing out water from the textiles.

In some embodiments, the housing may be invertible. Inverting the housing may be advantageous in that it can allow for the effective air drying or wipe drying of the housing, which can reduce the incidence of mildew, or the like, growing and/or can allow the housing to be used for other purposes. For example, the housing may be used to store items (e.g. a sleeping bag) and protect them from exposure to water when the device is not being used for washing textiles. In some embodiments, the housing may be used inside out or the correct way to store items when the device is not being used for washing textiles. Inverting the housing may be assisted by providing an opening in the waterproof housing that is substantially the width or diameter of the housing (e.g. greater than 75%, greater than 85% or greater than 90% of the width or diameter of the housing). In some embodiments, the housing may be invertible if the housing is sufficiently flexible and the opening is sufficiently large to allow the inside of the housing to be pulled through the opening, thereby inverting the housing.

In some embodiments, the housing may include a seal for sealing the inverted waterproof housing. The seal may be same seal as described above or a separate seal (e.g. a roll-down seal with fasteners may still be used by folding the straps of the inverted seal outwardly such that the fasteners are again on the outside of the housing and then rolling the seal down and fastening the fasteners to seal the inverted housing). In some embodiments, the waterproof housing may include a frictional washing surface on the outside such that the housing may be used to wash textiles when the waterproof housing is inverted. In some embodiments, the washing surface on the outside of the housing may include different sized projections and/or depressions and/or a different arrangement of projections and/or depressions to the internal frictional washing surface to allow different textiles to be washed on each washing surface. For example, the external surface may include a washing surface suitable for washing delicates (as described above), while the internal surface may include a washing surface suitable for washing durable textiles, or vice-versa. In some embodiments, one or both washing surfaces may perform the function of the gripping surface (described above) when on the outside of the housing.

The laundry device may include one or more removable frictional washing surfaces. In this regard, washing surfaces may be moved, replaced or interchanged and the same laundry device may be used to effectively wash different textiles without needing to invert the housing or separate the frictional washing surface into different regions (as described above).

The waterproof housing may include an absorptive material on an outside surface thereof, such that when the housing is inverted and wet textiles are placed therein, the absorptive material absorbs moisture from the wet textiles (i.e. assists drying). While the absorptive material may be integral to the housing, the absorptive material may be partially removable (i.e. one or more corners or edges may be detachable) or completely removable to allow the absorptive material to be wrung out and/or hung to dry. Absorptive materials are generally known in the art and may include, for example, a chamois, a towel, a durable tissue paper, an absorbent pad, a material containing a chemical absorbent (e.g. a sodium polyacrylate containing material), a sponge, a microfibre towel, fluff pulp, a woven synthetic (e.g. ShamWow™), etc. The absorptive material may be a material that can repeatedly absorb more than 2, 5, 10, 15, 50, or 100 times its weight in liquid.

The absorptive material may be provided in the form of a sheet, an open ended bag or a stuff sack. In use, wet clothing may be placed in the bag or sack to absorb water from the clothing. Optionally, the wet clothing may be pressed against the absorptive material to promote absorption. Clothing may then be removed and dried along with the bag. When not in use (and dry), the bag or sack may be used to store clean clothes and may optionally be provided with a clip, or the like, to facilitate attachment to the housing, which may be provided with a complementary clip, or the like.

While the present invention has been discussed in detail in relation to washing textiles while travelling, it will be appreciated that the laundry device according to the present invention may have domestic or commercial applications. Very few people in the Western society own washboards, yet washboards are effective at removing stubborn stains and in some instances may outperform washing machines. A limitation of traditional washboards is their bulk. In comparison, in some embodiments, the laundry devices according to the present invention may be rolled up or folded to a compact form. Furthermore, unlike traditional washboards, the laundry device according to the present invention may also be used to soak the textiles, thereby freeing up the laundry sink (if a sink is even available). The ability to effectively hand-wash textiles with reduced exposure to the cleaning material or without prolonged exposure of the user to water may also have domestic appeal.

The present invention also provides a portable laundry kit including a laundry device as previously described herein; and any one or more of the following: a cleaning material; a clothesline; a waterproofing liquid; an absorptive material; a puncture repair kit; and instructions for using the laundry device to wash one or more textile items.

The clothesline may be an elastic clothesline or an inelastic clothesline, including, for example a compact travel clothesline (e.g. a pegless clothesline including two or more twisted elastic strands). In some embodiments, the clothesline may also function as part of the seal. In some embodiments, the clothesline may be permanently or removably attached to the device.

The cleaning material may include any suitable textile cleaning material including, for example, washing liquid, washing powder, soap, detergent, shampoo, etc. In some embodiments, the cleaning material may include travel packs of cleaning material. In some embodiments, the cleaning material may include a concentrated cleaning material, an environmentally friendly cleaning material and/or a low allergenic cleaning material. The cleaning material may be a fabric softener free, perfume free, phosphate free and/or bleach free detergent (e.g. Atsko Sports Wash).

The waterproofing liquid may be any liquid that is able to coat, impregnate or encapsulate the waterproof housing material and polymerise or set to restore the waterproof properties of the waterproof housing. The waterproofing liquid may include, for example, silicone, fluropolymer, latex urethane, or DRW, or other suitable polymer based liquid. In some embodiments, the liquid may be provided in a spray dispenser or provided with an applicator (e.g. a brush or the like).

The absorptive material may include an absorptive material as described above and may take the form of a sheet, an open ended bag or stuff sack (e.g. with a draw-string closure) and/or may be attachable to the waterproof housing.

The puncture repair kit may include a patch, tape, waterproofing liquid, curable polymer, and/or an applicator.

The instructions may include any one or more of the directions provided herein in relation to washing textiles. The directions may include, for example, how many textiles to wash, how much water to add, how to expel air from the housing, how to wash the textiles, how to drain the textiles, how to rinse the textiles, how to dry the textiles, how to repair the laundry device, how to use any one or more features of the laundry device, etc.

The present invention also provides a method for washing a textile, the method including: i) inserting the textile, water and cleaning material into the housing of a laundry device as described herein; ii) sealing the opening; iii) gripping or pressing on an outer surface of the housing to press and rub the textile item against the frictional washing surface; wherein friction between textile item and the frictional washing surface augments the action of the cleaning material in washing the textile item. The method may also include expelling air from the housing before sealing the opening or through an outlet after sealing the opening and/or any other step/direction described herein with respect to the laundry device of the present invention.

In some embodiments, the present invention provides a method of producing a laundry device previously described herein, the method including attaching or applying a frictional washing surface to an inner surface of a flexible waterproof housing during production of the housing or after production of the housing or by attaching a frictional washing surface to cover an aperture in the flexible waterproof housing. The housing may be produced by extrusion (e.g. blown film), weaving, lamination, etc. and/or by joining sections by methods known in the art including, for example, one or more of stitching, tape sealing, bonding (e.g. adhesive, thermal, solvent, etc) or welding (e.g. hot gas welding, freehand welding, speed tip welding, extrusion welding, contact welding, hot plate welding, high frequency welding, injection welding, ultrasonic welding, friction welding, spin welding, laser welding or solvent welding). The method of joining will depend on the material used and the shape of the housing.

If provided as projections or depressions on/in a base, the frictional washing surface may be produced by compression or injection moulding, extrusion, calendaring or other suitable methods. The frictional washing surface may be attached to an inner surface of a housing during or after production of the housing. Alternatively, the frictional washing surface in the form of a sheet, or the like, may be attached to edges of the housing that delineate an aperture in the housing to cover the aperture. Methods of attaching the frictional washing surface to the housing are known in the art and may include, for example, one or more of stitching, bonding (e.g. adhesive, thermal, solvent, etc) or welding (e.g. as described above). Where the frictional washing surface covers an aperture in the housing, the back of the frictional washing surface may include a gripping surface, as previously described herein.

In some embodiments, the frictional washing surface may be formed by applying discrete projections (e.g. knobs, ridges, etc.) or discrete groups of projections to an inner surface of the housing or a material from which the housing will be produced (e.g. a sheet of housing material). The projections may be preformed projections attached to the inner surface of the housing or may be a polymerisable resin, liquid, paste or the like that is applied to the inner surface of the housing by methods including, for example, calendar coating, cast coating, curtain coating, die coating, extrusion, gravure coating, knife coating, spray coating, planar screening, rotary screening, reverse rolling, transfer coating rotogravure transferring, or the like.

The method may also include attaching or applying a gripping surface to the outer surface of the housing which backs the frictional washing surface. One or more polymer coated fabric sheets or rubber (or other high friction material) sheets, strips or patches may be attached to the outer surface of the housing using methods known in the art including, for example, one or more of stitching, bonding (e.g. adhesive, thermal, solvent, etc) or welding (e.g. as described above). Alternatively, a liquid gripping surface may be applied and cured to the outer surface of the housing (or a material to be used in the manufacture of the housing or attachment to the housing) by methods including, for example, calendar coating, cast coating, curtain coating, die coating, extrusion, gravure coating, knife coating, dipping, brush coating, spray coating, planar screening, rotary screening, reverse rolling, transfer coating rotogravure transferring, or the like.

In some embodiments, the method may include sewing a woven fabric onto the waterproof housing and subsequently attaching the frictional washing surface to the inside of the waterproof housing to cover and seal the seams of the sewn woven fabric, wherein the woven fabric is at least partially coated with a polymer to provide the gripping surface.

Reference will now be made to the following examples which describe particular embodiments of the present invention. These examples should not be taken as limiting the scope of the claims.

Figure 1B:
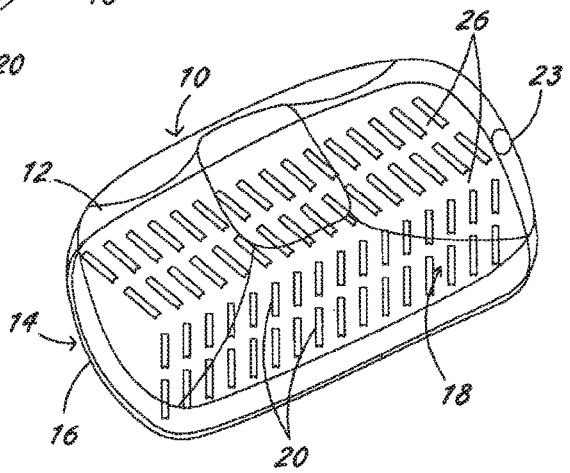
FIG. 1B is a perspective view of a second embodiment of the invention illustrating an alternative frictional washing surface and an outlet for removing water.
Figure 1C:
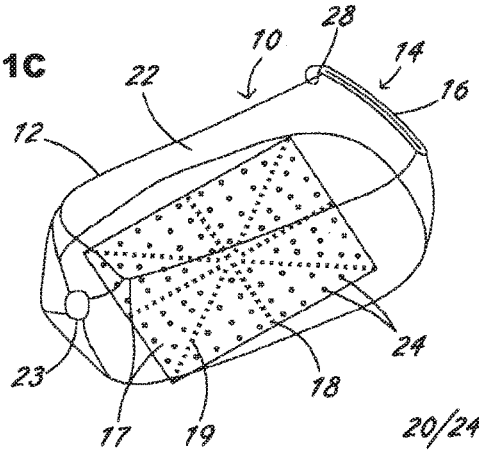
FIG. 1C is a perspective view of a third embodiment of the invention illustrating an alternative housing design and a further alternative frictional washing surface and an outlet for removing water.
Figure 1D:
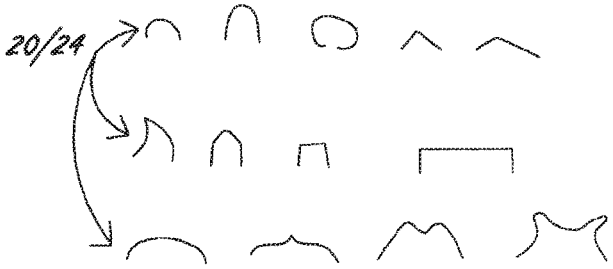
FIG. 1D is a cross sectional view of a range of example shapes of projections that can be used as part of the frictional washing surface according to an embodiment of the present invention.
Figure 2A:
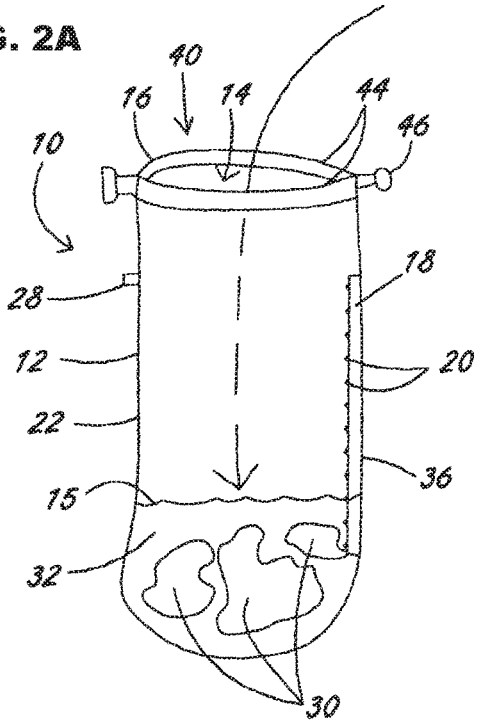
FIG. 2A is a perspective view of a fourth embodiment of the present invention showing water and textile items in the housing, the housing being illustrated as transparent for the purposes of viewing the interior of the housing.

FIGS. 1A, 1B and 1C show perspective views of laundry devices according to embodiments of the present invention. FIG. 1D shows examples of cross-sections of projections and/or depressions that may be used in laundry devices according to embodiments of the present invention. FIGS. 2A through 2F show drawings of the laundry device according to an embodiment of the present invention being used to wash clothing items. FIGS. 3A and 3B show drawings of the laundry device according to another embodiment of the present invention. FIG. 4A shows a cross-sectional view of the laundry device according to an embodiment of the present invention with an absorbent material on the outside of the housing. FIG. 4B shows a cross-sectional view of the laundry device from FIG. 4A, wherein the housing has been inverted. FIG. 4C shows a cross-sectional view of the laundry device according to an embodiment of the present invention with a second frictional washing surface on an outside surface of the housing. FIG. 4D shows a cross-sectional view of the laundry device from FIG. 4C, wherein the housing has been inverted.

As shown in FIG. 1A, laundry device 10 includes waterproof housing 12. Parts or all of housing 12 may be transparent (as illustrated), translucent or opaque. Housing 12 includes opening 14 through which clothing items, water and/or cleaning material (e.g. soap, detergent, etc.) are introduced. Housing 12 also includes seal 16 for sealing opening 14. Seal 16 is shown as a zip-lock style fastener. An inner surface of housing 12 includes frictional washing surface 18. Washing surface 18 includes a plurality of ridges 20. Housing 12 is substantially flexible and opposable wall 22 is capable of touching washing surface 18, when housing 12 is sealed and not full.

Housing 12 (or at least parts that are not transparent) is composed of a 80 denier 190 thread count plain weave nylon or a 30 denier nylon thread in a diamond grip-stop weave. The nylon is coated on one or both sides with a polyurethane or PVC coating and/or impregnated with silicone to improve the tear strength and/or waterproof nature of housing 12. Housing 12 is composed of multiple pieces that are single or multi stitched together (e.g. a felled seam with two rows of stitching) with a high stitch count and taped seams.

Once clothing, water and cleaning material has been introduced into housing 12, opening 14 is sealed by seal 16. Prior to sealing opening 14, air may be removed from housing 12, for example, by gently compressing housing 12. Once opening 14 has been sealed, clothing in housing 12 may be washed by gripping or pressing on housing 12 (e.g. on wall 22) to press and rub the clothing against ridges 20 in directions generally indicated by arrow a.

FIG. 1B illustrates laundry device 10 in accordance with another embodiment of the present invention. Waterproof housing 12 again includes frictional washing surface 18, opening 14 and seal 16. Housing 12 also includes outlet 23. Outlet 23 may be used to drain housing 12 once the clothing (not illustrated) has been cleaned. Alternatively, outlet 23 may be used to remove excess air from housing 12 before washing commences. Outlet 23 is a sealable outlet, which is preferably small enough that clothing (not illustrated) is retained in housing 12 as it is being drained. Alternatively, outlet 23 or housing 12 may include a mesh barrier or press studs to prevent clothing from passing through or coming near outlet 23 (not illustrated). Positioning outlet 23 opposite opening 14 can be advantageous in that it can allow effective rinsing of clothing. For example, laundry device 10 may be oriented such that opening 14 is at the top and water may be introduced though opening 12, which can pass though clothing and out of outlet 23, which is now at the bottom of waterproof housing. This may be performed in a continuous manner (i.e. with outlet 23 opened) or a batch manner (with outlet 23 periodically opened and closed). Washing surface 18 includes ridges 20 which are angled towards outlet 23. Washing surface 18 also includes unridged portions 26 that effectively provide channels to promote water drainage along washing surface 18 to outlet 23.

FIG. 1C illustrates laundry device 10 in accordance with another embodiment of the present invention. Waterproof housing 12 again includes opening 14, seal 16, outlet 23 and frictional washing surface 18, which is shown including a plurality of knobs 24. Knobs 24 and thus washing surface 18 may take up part or the entire bottom surface of housing 12. Knobs 24 may have a regular shape, thereby allowing clothing to be cleaned by rubbing them in any direction against knobs 24. Alternatively, knobs 24 may be irregularly shaped and may allow cleaning only in some directions or differential cleaning in different directions.

Housing 12 also includes valve 28 which can allow air to be removed from housing 12 after opening 14 is sealed with seal 16. To do so, laundry device 10 is oriented such that valve 28 is located at the top. Valve 28 is then opened and pressure is applied to housing 12. Once substantially all the air has been removed from housing 12, valve 28 may be closed. Valve 28 can allow for simpler use of laundry device 10 as a user can simply seal opening 14 without having to expel air through opening 14. There is also less likelihood of spillage of water by expelling air though valve 28.

As can be appreciated, the waterproof housing may be produced in any suitable shape. In the embodiment illustrated in FIG. 1C, housing 12 has more of a rectangular shape with a larger wall 22 opposing washing surface 18. Washing surface 18 includes base 17 on which knobs 24 are provided. Base 17 also includes flex lines 19 which increase the flexibility of base 17 and allow greater flexing of the base 17 to assist in inverting housing 12 through opening 14 and/or wringing of water out of the clothing.

As can also be appreciated, washing surface 18 may include any arrangement of ridges 20 and/or knobs 24. Ridges 20 and/or knobs 24 may be sized and shaped appropriately. For example, FIG. 1D illustrates cross-sections of some shapes of ridges 20 and/or knobs 24 that may be used for frictional washing surface 18. As illustrated, many of the cross-sections include projections with a tapered profile or include projections with parts thereof that have a tapered profile. The tapered profile can increase friction and/or reduce the weight or volume of the ridges or knobs. Knobs 24 may have identical cross-sections when cross-sections are taken from another plane (i.e. the knobs 24 may have radial symmetry around a vertical axis).

FIGS. 2A through 2F illustrate how laundry device 10 may be used to clean clothing. Laundry device 10 includes tubular shaped waterproof housing 12 (70 denier polyurethane coated nylon), frictional washing surface 18 (with ridges 20 that have heights of between 1.5 mm and 4 mm), opening 14, seal 16, beach ball-style valve 28 and outlet 23.

Housing 12 has an unsealed capacity of 13 L and sealed capacity of ~10 L (due to the roll-down seal). Housing 12 also includes gripping surface 36 on the outside, which backs washing surface 18. As shown in FIG. 2A, clothing 30, water 32 and cleaning material (shown in solution with water 32) are introduced into housing 12 through opening 14 to bring the volume in the bag to optimal fill marker 15. In this regard, housing 12 is not substantially filled (e.g. clothing and water makes up between 35% and 50% of the sealed capacity of housing 12). Larger volumes of water may be used, although in some embodiments, a user may have difficulty gripping or pressing clothing 30 through housing 12 and rubbing it against washing surface 18. In this case, housing 12 may be shaken to contact clothing 30 against washing surface 18 although larger ridges 20 may be required to compensate for the reduction in friction between clothing 30 and washing surface 18.

Figure 2B:
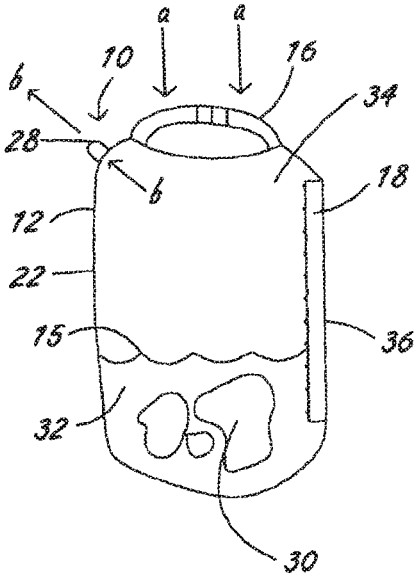
FIG. 2B is a perspective view of the fourth embodiment of the present invention showing the housing with the opening sealed and air being removed through the air release valve.
Figure 2C:
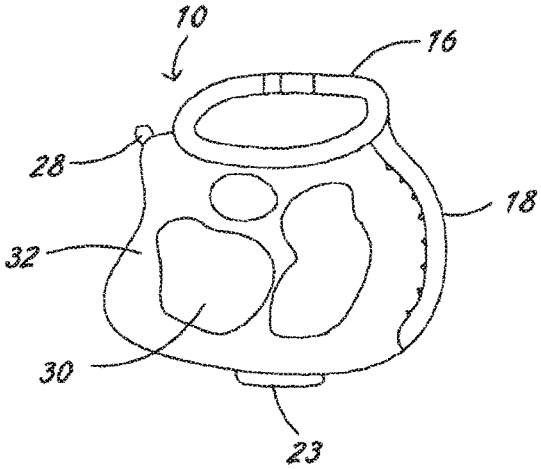
FIG. 2C is a perspective view of the fourth embodiment of the present invention showing the housing with the air removed.
Figure 2D:
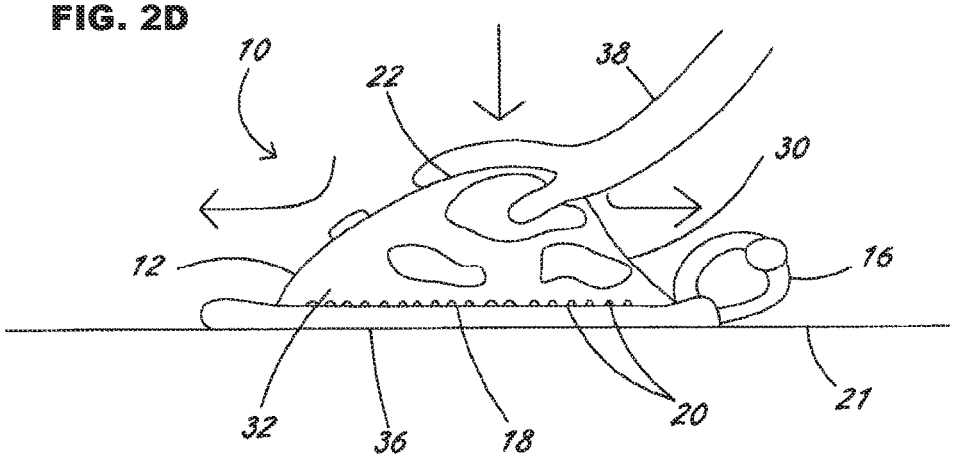
FIG. 2D is a perspective view of the fourth embodiment of the present invention showing the laundry device on a surface with a user gripping or pressing on an outer surface of the housing to press and rub the textile items against the frictional washing surface.
Figure 3A:
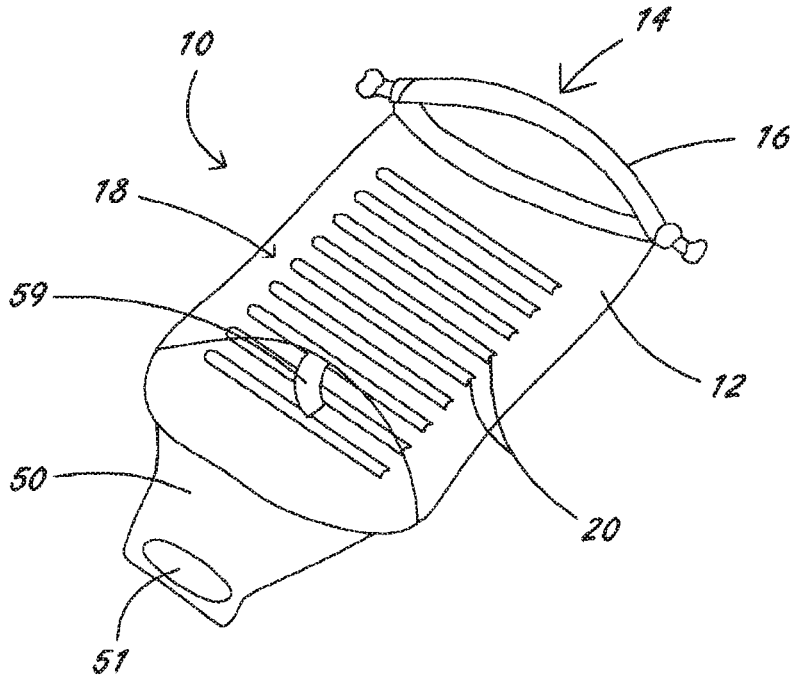
FIG. 3A is a perspective view of a fifth embodiment of the present invention showing a further alternative frictional washing surface and a tab to restrain the laundry device.
Figure 3B:
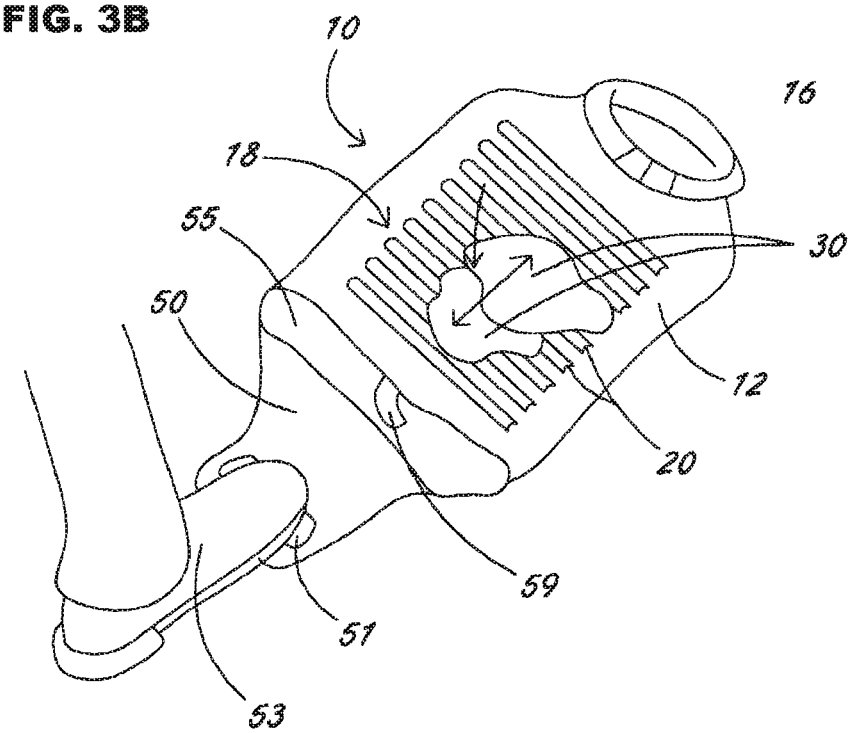
FIG. 3B is a perspective view of the fifth embodiment of the present invention showing a user with a foot on the tab and textile items in the housing with the motion of the textile items against the frictional washing surface indicated by arrows.

As shown in FIG. 2B, opening 14 is then sealed with seal 16 illustrated as roll-down type fastener 40. Fastener 40 includes clips 46 and straps 44. Straps 44 are brought together then rolled down housing 12 at least twice (preferably at least 3, at least 4, or at least 5 times). Straps 44 are then bent to allow engagement of clips 46 (25 mm duraplex buckle), which clip together to prevent straps 44 from unrolling. One of the straps 44 is lightweight polypropylene stiffener and the other is a non-wicking chlorosulfonated polyethylene strap. Valve 28 is opened during or after fastening and pressure is applied to housing 12, for example, as indicated by arrows a. As housing 12 is compressed, air 34 is expelled though valve 28, as indicated by arrows b. Once substantially all air 34 has been expelled from housing 12, valve 28 is closed (FIG. 2C).

To wash clothing 30, laundry device 10 is placed on a flat, curved or undulating surface 21 with gripping surface 36 contacting the surface the laundry device 10 is placed on. Gripping surface includes a bumpy or flat PVC, silicone or urethane surface attached to the housing directly or via a sewn polyester fabric. As washing surface 18 is flexible it is able to substantially conform to the surface it is placed on. If a 30 denier silnylon housing is used, a thin coat of a tacified silicone may be applied to form the gripping surface.

To wash clothing 30, a user grips or presses on clothing 30 through housing 12 with their hand 38 (FIG. 2D) on wall 22. Alternatively, the user may grip or press on clothing 30 through housing 12 with their hand 38 on the end wall of the housing 12 which includes outlet 23. Downward pressure is applied to bring clothing 30 into hard contact with washing surface 18. The user may then rub clothing 30 against ridges 20 of frictional washing surface 18 in a back and forth or circular motion, depending on the arrangement of ridges 20. By repeatedly contacting ridges 20 in the presence of water and a cleaning material, dirt, oil, stains, etc may be dislodge or removed from clothing 30. In some embodiments, housing 12 may include transparent or translucent portions that allow the user to assess whether clothing 30 is clean enough. Gripping surface 36 grips with the surface it is placed on to restrict movement of frictional washing surface 18. Without gripping surface 36, housing 12 and washing surface 18 are likely to move as the user pushes clothing 30, thereby reducing the effective contact between ridges 20 and clothing 30. A user may also grip laundry device 10 with their other hand for stability. Rubbing clothing 30 against washing surface 18 may be repeated as required and the process may also include soaking of clothing 30 in housing 12 for a desired period of time.

Figure 2E:
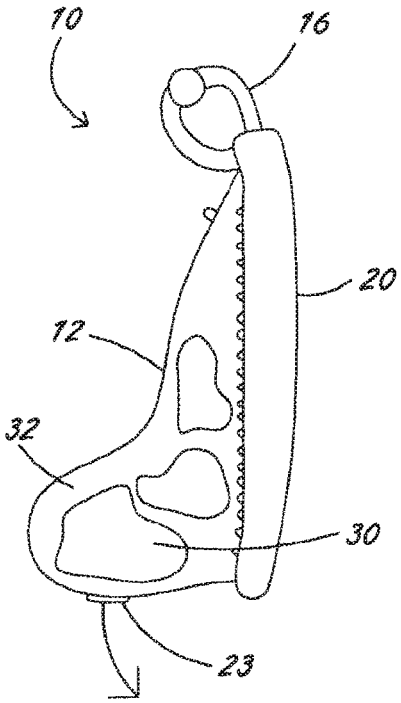
FIG. 2E is a perspective view of the fourth embodiment of the present invention showing water being released from the housing through a water outlet.

Once the cleaning process has concluded, laundry device 10 may be oriented such that outlet 23 is at the bottom and outlet 23 may be opened to allow water 32 to be drained from waterproof housing 12 (FIG. 2E). As laundry device 10 is flexible, it may be rolled, twisted, compressed or otherwise manipulated to wring water 32 from housing 12 and clothing 30. Alternatively, or in addition, laundry device 10 may be gripped by a portion opposite to outlet 23 (e.g. by seal 16) and swung around to expel water from waterproof housing 12 and clothing 30 using centrifugal forces.

Figure 2F:
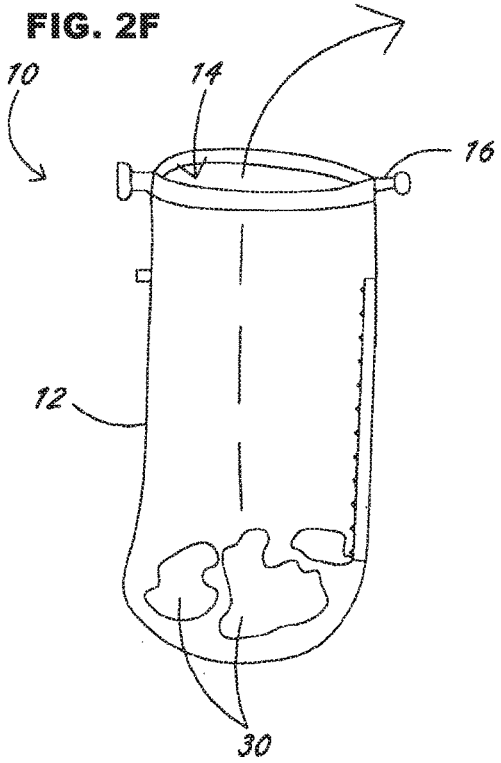
FIG. 2F is a perspective view of the fourth embodiment of the present invention showing the textile items being removed from the housing.

Optionally, clothing 30 may be rinsed in housing 12. Rinsing water may be introduced via opening 23 or opening 14 (once seal 16 has been unsealed). Once rinsing water has been introduced, housing 12 and may optionally sealed again, with housing 12 shaken or clothing 30 again rubbed against washing surface 18 to rinse clothing 30 (i.e. clothing 30 may be rinsed in a batch fashion). Alternatively, rinsing water may be introduced though opening 14 while outlet 23 is open, thereby allowing rinsing water to flow over clothing 30 and remove residual cleaning material and/or dirt, oil, etc. (i.e. clothing 30 may be rinsed in a continuous flow process). As shown in FIG. 2F, once the cleaning process has concluded, seal 16 is unsealed and clothing 30 is removed from housing 12. Housing 12 may be inverted through opening 14 to accelerate drying of the inside of housing 12.

FIG. 3A illustrates laundry device 10 in accordance with another embodiment of the present invention. Waterproof housing 12 again includes opening 14, seal 16 and frictional washing surface 18, which is shown including a plurality of ridges 20. Laundry device 10 also includes tab 50, which may optionally include aperture 51 and fastener 59.

FIG. 3B illustrates laundry device 10 from FIG. 3A in use. The laundry device 10 is sealed and contains clothes 30, water and cleaning material (not illustrated) in housing 12. When used to wash clothing 30, a user may place their foot 53 or an object on tab 50 or through aperture 51 to restrain laundry device 10 and washing surface 18, thereby allowing clothing 30 to be effectively rubbed against washing surface 18. The user may grip the opposite end of the housing to tab 50 to further restrict movement of the housing. Conveniently, tab 50 may attach to housing 12 by means of fasteners (e.g. Velcro strap 59) when not in use. In this regard, tab 50 may be used to support end wall 55 when attached to Velcro strap 59. Tab 50 and/or fastener 59 may also be used as an attachment member to hang laundry device 10 from an object to allow water to drain from housing 12 through opening 14, thereby assisting drying of housing 12.

In some embodiments, housing 12 may be inverted (i.e. turned inside out). As discussed above, housing 12 may be inverted to assist in drying of the housing 12. However, inverting waterproof housing 12 may confer other advantages. For example, as shown in FIG. 4A, housing 12 may include absorbent fabric 52 (e.g. a chamois or ShamWow™) attached to the outside surface (e.g. via sewing or Velcro). Laundry device 10 may be used as described above with clothing 30 rubbed against frictional washing surface 18. Once washing has been completed and clothing 30 has been rinsed, housing 12 may be inverted and clothing 30 placed in the inverted housing 12 (FIG. 4B). As absorbent fabric 52 is now on the inside of housing 12, it may draw water from clothing 30. To assist in this process, housing 12 may be rolled, shaken or compressed to bring clothing 30 into contact with absorbent fabric 52. Clothing 30 may then be removed and hung up to complete drying. Housing 12 may be reinverted and absorbent fabric 52 left to dry. Alternatively, absorbent fabric 52 may be wrung out while attached, partially attached or removed from housing 12. Thus, absorbent fabric 52 may be used to accelerate drying of clothing 30.

As shown in FIG. 4C, housing 12 may include frictional washing surface 18 on an inner surface thereof and frictional washing surface 18' on an outer surface thereof. Washing surface 18 includes larger ridges 20, while washing surface 18' includes smaller ridges 20'. When laundry device 10 is used as shown in FIG. 4C, durable clothing may be washed against washing surface 18. To wash delicate clothing, waterproof housing 12 is inverted and delicate clothing is washed against washing surface 18'. As such, the same laundry device 10 may be used to clean different types of clothing (FIG. 4D).

Any of the illustrated laundry devices may be part of a kit, which may also include a clothesline, and/or a cleaning material, and/or a waterproofing liquid, and/or an absorptive material; a puncture repair kit; and/or instructions. Where a clothesline or absorptive material is included in the kit, the clothesline and/or absorptive material may be attached or attachable to the waterproof housing.

What is claimed is:

1. A laundry device including:

i) a flexible waterproof housing for housing a textile item, water and cleaning material;

ii) an opening in the housing for inserting or removing the textile item; iii) a seal for sealing the opening;

iv) a frictional washing surface on an inner surface of the housing; and v) an air outlet of less than 10 $cm^2$ for removing air from the housing when sealed;

wherein the outlet allows air to be removed from the sealed housing to enable a user to grip or press on an outer surface of the housing to press and rub the textile item against the frictional washing surface to effect cleaning.

2. The laundry device of claim 1, wherein the air outlet has a surface area less than 3 $cm^2$.

3. The laundry device of claim 1, wherein the air outlet has a surface area less than 1 $cm^2$.

4. The laundry device of claim 1, wherein the air outlet includes a valve or cap to control airflow through the air outlet.

5. The laundry device of claim 4 wherein the valve is made of a soft material.

6. The laundry device of claim 1, wherein the air outlet includes a beach ball-style valve.

7. The laundry device of claim 1, wherein the air outlet is provided on a substantially opposing face of the housing to the frictional washing surface.

8. The laundry device of claim 1, wherein the air outlet is located substantially adjacent to the seal when the opening is sealed.

9. The laundry device of claim 1, wherein the seal is a roll-down seal.

10. The laundry device of claim 1, wherein the housing includes a fabric coated on at least one side with a polymer or a fabric impregnated with a polymer.

11. The laundry device of claim 10, wherein the fabric includes a fibre, filament, thread or yarn with a denier between 1 and 300.

12. The laundry device of claim 10, wherein the fabric is a nylon, polyethylene or polyester fabric and the polymer is a polyurethane, PVC or silicone.

13. The laundry device of claim 1, wherein the frictional washing surface includes a plurality of projections or depressions provided on a base which is attached to the housing.

14. The laundry device of claim 1, wherein the portion of the housing backing the frictional washing surface has a higher coefficient of friction than the portion of the housing not backing the frictional washing surface.

15. The laundry device of claim 14, wherein the portion of the housing backing the frictional washing surface includes an elastomeric polymer layer, elastomeric polymer coat or elastomeric polymer projections.

16. The laundry device of claim 1, wherein the housing includes an optimal water level marking that indicates a level between 20% and 55% of the capacity of the housing when sealed.

17. The laundry device of claim 1, wherein the housing includes a water outlet substantially opposite the opening for draining water from the device after washing.

18. The laundry device of claim 17, wherein the water outlet includes an opening less than 30 $cm^2$.

19. The laundry device of claim 17, wherein the water outlet includes a textile retainer for preventing textiles from passing through the water outlet as water is drained from the housing through the water outlet.

20. The laundry device of claim 1, wherein the housing is substantially cylindrical with a flexible bottom, the frictional washing surface is provided on a sidewall and a valve is located on the housing near the opening and on a face of the housing that is substantially opposite the frictional washing surface.

* * * * *